US008572795B2

(12) United States Patent
Green

(10) Patent No.: US 8,572,795 B2
(45) Date of Patent: Nov. 5, 2013

(54) ARMORED SPONGE CLEANING MITT

(76) Inventor: Daniel Joseph Green, Richmond Hill, GA (US)

( * ) Notice: Subject to any disclaimer, the term of this patent is extended or adjusted under 35 U.S.C. 154(b) by 322 days.

(21) Appl. No.: 13/068,401

(22) Filed: May 10, 2011

(65) Prior Publication Data

US 2012/0284946 A1 Nov. 15, 2012

(51) Int. Cl.
*A47L 21/04* (2006.01)

(52) U.S. Cl.
USPC ..... 15/218.1; 15/229.11; 15/218; 15/210.1

(58) Field of Classification Search
USPC ..... 15/218, 218.1, 104.92, 105, 229.11, 15/244.3, 227, 220.4, 210.1
See application file for complete search history.

(56) References Cited

U.S. PATENT DOCUMENTS 1,219,993 A * 3/1917 Omoto ..... 15/218.1
1,349,123 A * 8/1920 Erikson ..... 15/218.1
5,009,195 A * 4/1991 Damm ..... 119/633
5,918,341 A * 7/1999 Hale ..... 15/209.1
5,979,003 A * 11/1999 Billat ..... 15/104.94
6,192,543 B1 * 2/2001 Lee ..... 15/118
7,307,055 B2 * 12/2007 Cook et al. ..... 510/438
7,383,590 B1 * 6/2008 Duncan ..... 2/158
2004/0117935 A1 * 6/2004 Cavalheiro ..... 15/244.1
2010/0162508 A1 * 7/2010 Olhe et al. ..... 15/229.11

* cited by examiner

*Primary Examiner* — Shay Karls
(74) *Attorney, Agent, or Firm* — Sonya C. Harris; Invention Services

(57) ABSTRACT

An armored sponge cleaning mitt device for cleaning sharp-edged objects, such as the blades of knives and other cutlery apparatus. The present invention is a cleaning device that can be readily slipped about the blade of a knife, for example, in a substantially enclosing manner such as to effectively provide cleaning of the blade surfaces of the device while being frictionally slide along the blade. The armored sponge cleaning mitt is sized and dimensioned to fit about the hand of a wearer and encasing the fingers and thumb and comprising several layers bonded together to form a unitary structure. This multi-layered mitt includes an abrasive layer for providing a scouring cleaning surface, a sponge layer, a fabric layer and an armored rigid layer providing structure and protection from the sharp edges being cleaned. In some embodiments, the multilayered mitt may comprise an exterior fabric layer with an interior abrasive scouring cleaning surface layer.

9 Claims, 7 Drawing Sheets

ARMORED SPONGE CLEANING MITT

FIELD OF INVENTION

The present disclosure relates generally to a cleaning mitt, and more specifically, to a cleaning mitt for sharp edged objects such as blades, cutlery, and the like.

BACKGROUND

Cleaning mitts as well as devices for cleaning cutlery and other sharp edged devices are well known in the art. They range from gloved devices to complex machinery that not only clean the knives, etc., but also provide means for sharpening the blades of such devices. U.S. Pat. No. 6,192,543 for a Cleaning Mitt Apparatus teaches of a cleaning mitt that is flexible and may be folded during use about center seam and having abrasive portions. U.S. Pat. No. 7,307,055 for Cleaning Implements generally discloses a foldable abrasive cleaning device which may be impregnated with a substance to aid in cleaning. The Multi Purpose Hand Grip of U.S. Pat. No. 7,383,590 teaches of a hand mitt device which may be used to assist with the gripping of an object while protecting the hand. This gripping mitt comprises a reinforcing interior layer which is disclosed as including metal. The Hand Sized, Controlled-Fold, Cleaning Sleeve disclosed in U.S. Pat. No. 5,918,341 shows the general art of a multiple folding abrasive cleaning device. The U.S. Published Patent Application 20100162508 for a Flexible Cleaning Article teaches of a multi-layered, flexible cleaning article which could comprise sponge material and have scouring surfaces.

SUMMARY

This application relates to an armored sponge cleaning mitt device for cleaning sharp-edged objects, such as the blades of knives and other cutlery apparatus. Accordingly, it is an object of the present invention to provide a cleaning device that can be readily slipped about the blade of a knife, for example, in a substantially enclosing manner such as to effectively provide cleaning of the blade surfaces of the device while being frictionally slide along the blade.

In accordance with an aspect of the present disclosure, there is disclosed an armored sponge cleaning mitt device that can fit within the hand of a wearer and comprising several layers including abrasive for providing an abrasive cleaning surface.

In accordance with another aspect of the present disclosure, there is disclosed an armored sponge cleaning mitt device that can fit within the hand of a wearer and comprising several layers including an absorbent and porous sponge-like layer for providing a layer which can provide a means for receiving and disseminating fluid and/or solid materials such as water and/or cleansing substances.

In accordance with yet another aspect of the present disclosure, there is disclosed an armored sponge cleaning mitt device that can fit within the hand of a wearer and comprising several layers including an interior, rigid, armored layer which serves to protect the hand of the wearer from the sharp edges during cleaning.

In accordance with another aspect of the present disclosure, there is disclosed an armored sponge cleaning mitt device that can fit within the hand of a wearer and comprising several layers, as above, and wherein the mitt is lightweight and also semi-flexible so as to fold about the sharp edge of a cutlery device in an opening and closing manner to provide frictional cleaning of the sharp edges.

In accordance with another aspect of the present disclosure, there is disclosed an armored sponge cleaning mitt device that can fit within the hand of a wearer and comprising gripping members on an exterior layer thereof for facilitating secured wearing and handling by a user.

In accordance with another aspect of the present disclosure, there is disclosed an armored sponge cleaning mitt device sized and dimensioned to fit within the hand of a wearer which will be durable and efficient in use, and simple to manufacture, and placed upon the market at a reasonable cost.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

BRIEF DESCRIPTION OF THE DRAWINGS

Embodiments of the present disclosure are described herein with reference to the drawings, in which.

The novel features which are characteristic of the invention, as to organization and method of use, together with further objects and advantages thereof, will be better understood from the following disclosure considered in connection with the accompanying drawings in which one or more preferred embodiments of the invention are illustrated by way of example. It is to be expressly understood, however, that the drawings are for the purpose of illustration and description only and are not intended as a definition of the limits of the invention.

As used herein, the term "comprises" refers to a part or parts of a whole, but does not exclude other parts. That is, the term "comprises" is open language that requires the presence of the recited element or structure or its equivalent, but does not exclude the presence of other elements or structures. The term "comprises" has the same meaning and is interchangeable with the terms "includes" and "has". The term set has the meaning of one or more of said element. Furthermore, any use of the term "or" as used herein is generally intended to mean "and/or" unless otherwise indicated. Combinations of components or steps will also be considered as being noted, where terminology is foreseen as rendering the ability to separate or combine is unclear.

DETAILED DESCRIPTION

Figure 1:
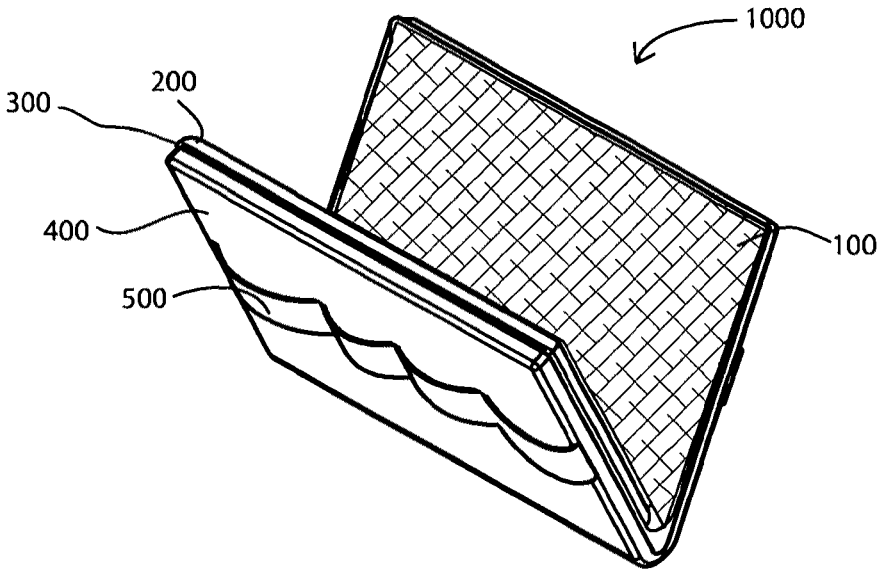
FIG. 1 is a perspective diagram of the armored sponge cleaning mitt device in accordance with an embodiment of the present invention.
Figure 2:
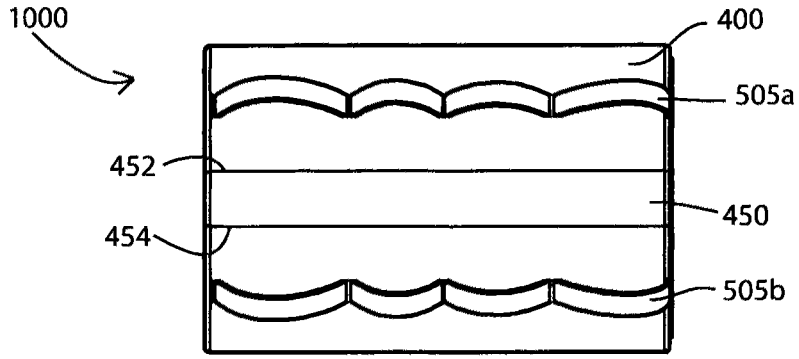
FIG. 2 is plan rear view of the armored sponge cleaning mitt device in an opened configuration, according to certain embodiments of the present disclosure.
Figure 3:
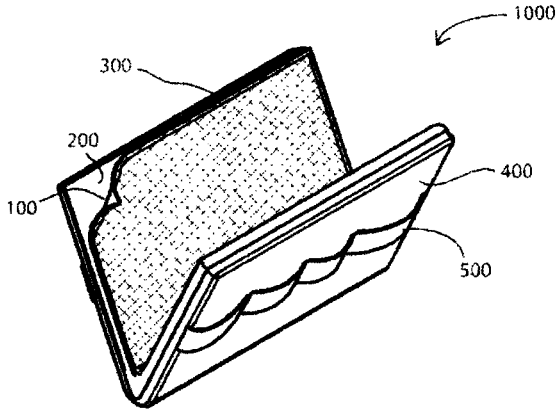
FIG. 3 is a perspective diagram of the armored sponge cleaning mitt device in a partially closed configuration and illustrating an abrasive layer, according to certain embodiments of the present disclosure.
Figure 4:
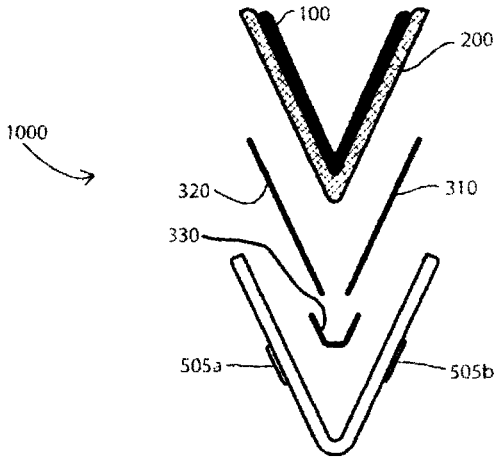
FIG. 4 is a partially exploded diagram of the armored sponge cleaning mitt device illustrating layers thereof according to certain embodiments of the present disclosure.
Figure 5:
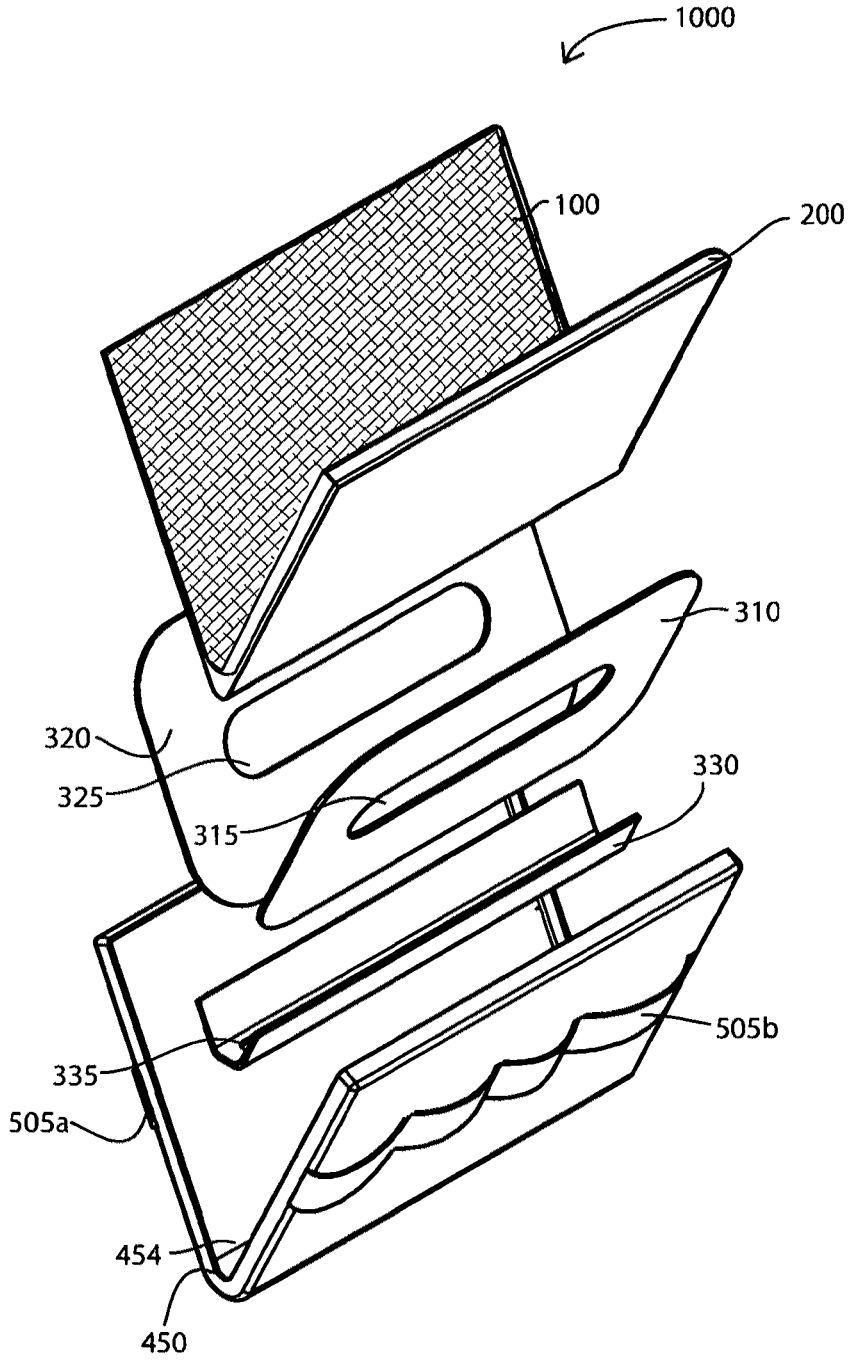
FIG. 5 is an exploded diagram of the armored sponge cleaning mitt device illustrating layers thereof according to certain embodiments of the present disclosure.

Referring now to the drawings, FIG. 1 illustrates a perspective view of the armored sponge cleaning mitt (ASCM) 1000. The ASCM 1000 is comprised of a plurality of layers which essentially form a unitary structure of at least two opposing side panels 410 and 420 which operatively open and close about a spine 450 to provide frictional, sponge-like cleaning of sharp edged devices such as articles of cutlery like knives, blades and the like. Such a cleaning article may be particularly useful in any environment where such sharpened objects may be of use and may become soiled. These sharpened objects may range in usages from surgery to cooking.

As can be best seen in FIGS. 1-5, the ASCM 1000 may be comprised of an abrasive layer 100, an absorbent layer 200, and a fabric material 400 which receives a set of rigid armoring members (RAMs) 300 on its interior surface, and a set of gripping members 500 on its exterior surface. Each of the layers may be bonded to one another such that the abrasive layer 100 is bonded to the absorbent layer 200 which is thereby bonded to the fabric layer 400. FIG. 6, discussed in further detail below, illustrates the fabric layer 400 and the set of RAMs 300 bonded thereon. The bonding of each of the layers 100, 200, 300, and 400 may be by way of suitable bonding methods known to artisans having ordinary skill in the art, such as chemical, thermal, and or mechanical bonding means. Such bonding means including, but not limited to adhesive bonding agents, heat sealing processes, mechanical attaching such as stitching, crimping, fastening The abrasive layer 100 may be formed in a variety of manners such as to provide a roughened, abrasive, scouring surface for additional frictional cleaning of a soiled knife surface. One example of forming such a layer may comprise a fabric material woven in such a manner as to provide abrasive characteristics, such as a mesh pattern (such as glass mesh), or a raised interwoven material patterns forming a course nature. The abrasive layer 100 may also be formed of any suitable abrasive material or set of materials well known in the art.

Figure 9:
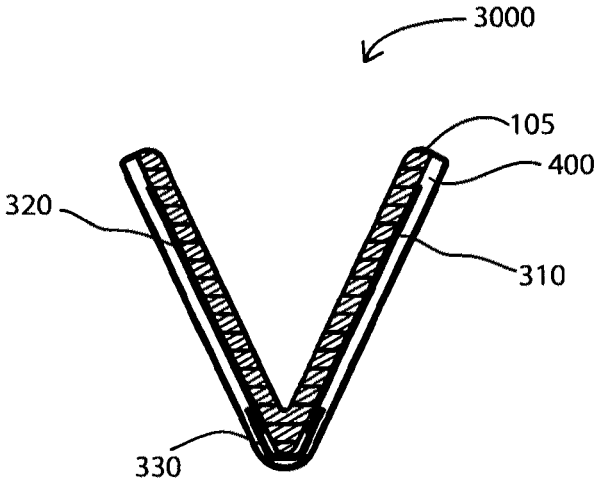
FIG. 9 is a side view of the armored sponge cleaning mitt device according to another embodiment of the present disclosure illustrating a solitary scouring surface layer.

In order to have the required abrasive characteristics necessary for the abrasive layer 100 to give desired scouring results when cleaning, said abrasive layer 100 may be comprised of well known abrasives including nonmetallic materials such as aluminum oxide, emery, silicon carbide, silica, pumice stone, polymers and hard plastics, and the like, as well as metals of various hardness, such as steel, bronze, or copper. In some instances, the materials may include multiple layers such as metallic and/or nonmetallic materials encased in polymers or hard plastics (e.g., to avoid corrosive effects). It is to be understood that the materials comprising the abrasive layer 100 may have absorbent characteristics, such that when in use the abrasive layer 100 may be both scouring and absorbent. An example of this functionality includes the ASCM 3000 (as illustrated in FIG. 9, and discussed further below) being used to clean a soiled knife or other sharp edged object and employing liquid and cleaning agents and said abrasive layer 105 at least partially containing (thus absorbing) water and/or cleaning agents for facilitating cleaning of said sharp edged objects.

The absorbent layer 200 may be comprised of any suitable sponge-like or ordinary sponge materials well known in the art, which, in their broadest aspects, might be considered to be open-celled foams. For example, both natural sponges and artificial cellulosic sponges provide fluid holding and dispensing properties which are useful during cleaning. Many common sponge materials can have non-uniform cell sizes which provide fluid retention characteristics by the sponge. And, while common sponge materials can imbibe substantial quantities of aqueous fluids, they can also release the imbibed fluids with very little pressure, and thus aiding in the cleaning process, especially when cleansing agents are employed. Cleansing agents may be impregnated into the absorbent layer 200 during use when cleaning a knife or blade, or in a prior a manufacturing phase of the sponge-like material. Suitable cleaning agents include detergents, polishing solutions, or anti-microbial solutions that may assist in the cleaning and/or polishing of the cutlery element.

The fabric material layer 400 may be comprised of any suitable durable material that is flexible and durable. This fabric layer 400 may consist of one or more sub-layers of one or more material fabrics to provide structural support for encasing the set of RAMS 300. The fabric may be synthetic or natural fiber structures, or blends thereof. Synthetic fiber structure refers to a fiber structure created from man-made materials such as petroleum distillates or regenerated or modified cellulosic materials. In most instances, synthetic fiber structures generally have a fiber length greater than about 0.01 meter. Examples of a synthetic fiber structure include nonwoven webs having petroleum distillate fibers, or semi-synthetic regenerated cellulosic fiber structures, such as products sold under the trade designation RAYON®. Natural fibers are textile fibers of mineral, plant, or animal origin. The more common natural fibers include cotton, wool, linen, hemp, and ramie.

Figure 7:
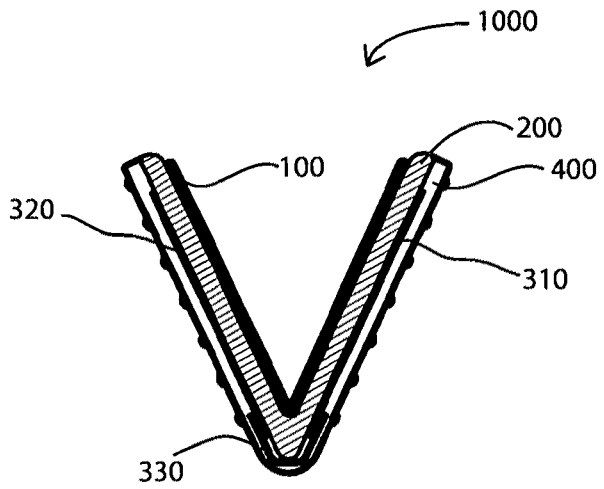
FIG. 7 is a side view of the armored sponge cleaning mitt device according to certain embodiments of the present disclosure.
Figure 8:
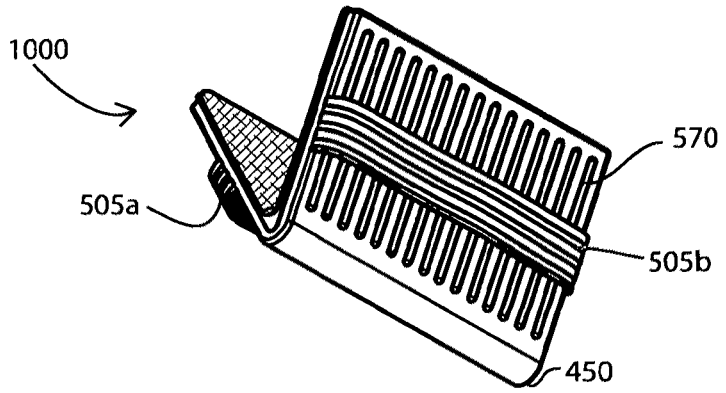
FIG. 8 is a perspective view of the armored sponge cleaning mitt device according to another embodiment of the present disclosure illustrating alternative exterior gripping means on an exterior surface thereof.

The gripping members 500 may be at least partially connected to the fabric material. The gripping members 500 may comprise a set of one or more straps 505*a* and 505*b* or band 506*a* and 506*b* on the sides of the ASCM 1000. The straps 505*a* and 505*b* may comprise a series of loop structures, or the like, for facilitating the secured placement of individual fingers within the straps 505*a* and 505*b*. The bands 506*a* and 506*b* may be configured to extend about more than one finger, or the expanse of the hand of the user. The gripping members 500 can be made from resilient material such as a conventional, semi-flexible, semi-rigid plastic or rubberized elastomeric material well known in the art. The gripping members 500 may also take the form of finger inserts, in lieu of straps. As shown in an alternative embodiment illustrated in FIGS. 7 and 8, frictional engagement means 570 may be further provided on either of the side panels 410 and 420 on the exterior surface of the fabric layer 400. The frictional engagement means 570 provides additional gripping effect and can be comprised of ridges, notches, grooves or other suitable demarcations to the material, and may comprise other friction reinforcing materials such as, for example, rubberized portions.

Figure 6A:
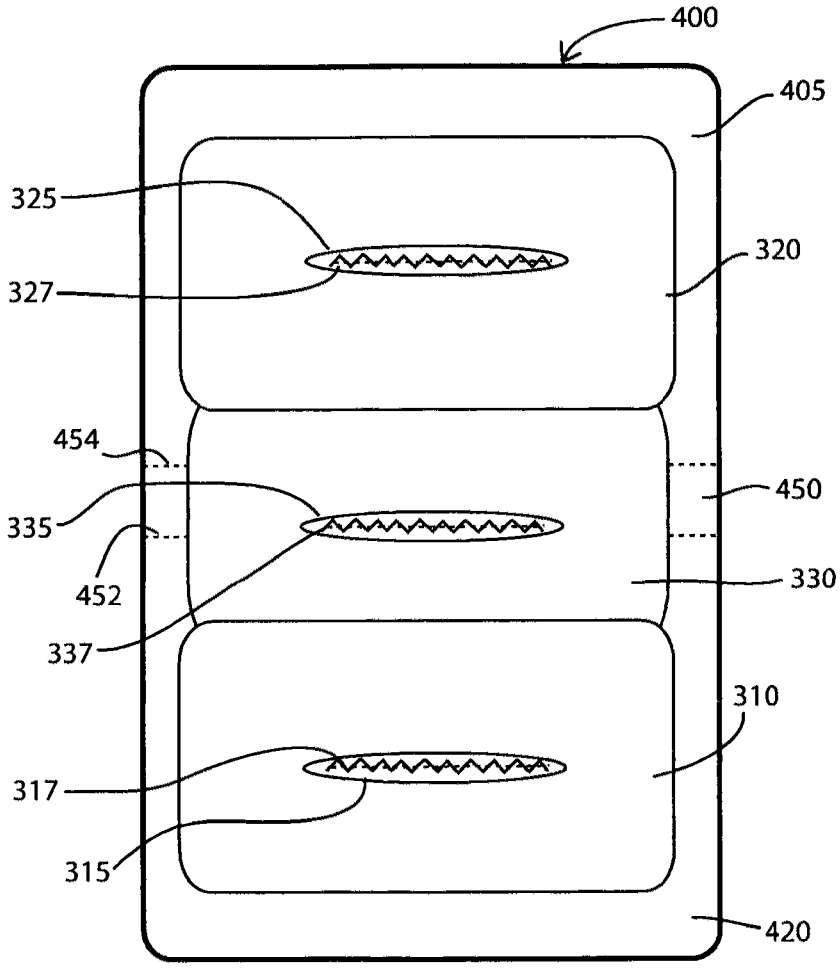
FIG. 6A is a top plan view illustrating an interior side of the fabric layer and a set of rigid members according to certain embodiments of the present disclosure.
Figure 6B:
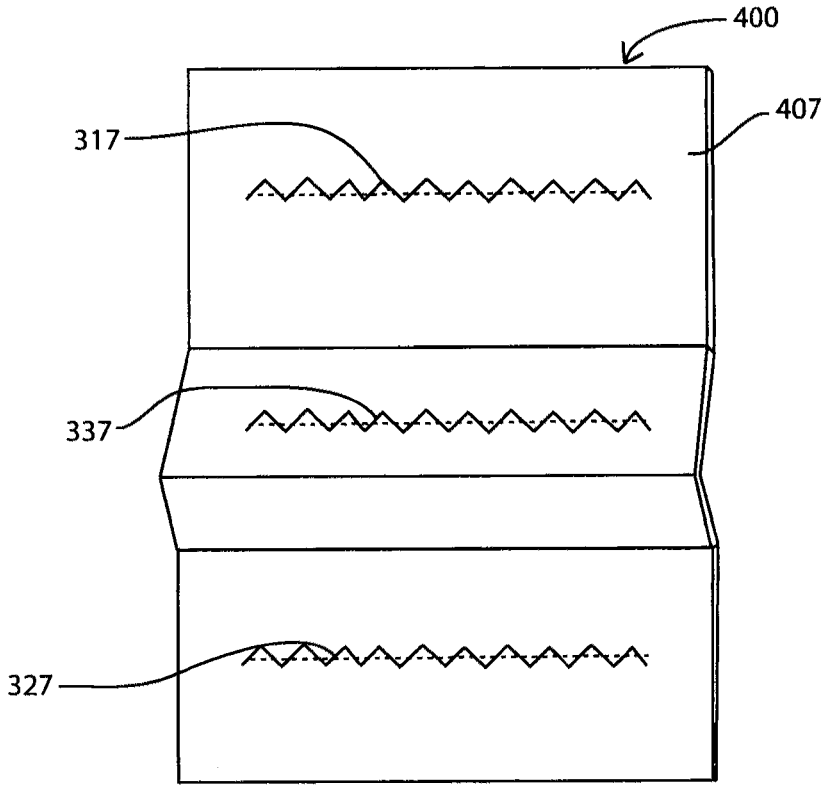
FIG. 6B is a front perspective view illustrating an exterior side of the fabric layer according to certain embodiments of the present disclosure.

Referring to FIGS. 6A and 6B, it can be seen that on either side of the spine 450 are a set of folding axes 452 and 454 to facilitate some ergonomic fitting of the hands of the user about the side panels 410 and 420 of the ASCM 1000. These folding axes 452 and 454 are essentially material creases which facilitate encasing, and at least partially containing of the set of RAMs 300, namely plates 310, 320 and 330. As can be seen in the partially exploded view of FIG. 4 and FIG. 5, as well as FIG. 6A and FIG. 7, the plates 310, 320, and 330 can be structurally dimensioned, sized and configured such that plates 310 and 320 overlaps centrally located plate 330. This can reinforce structural rigidity of the ASCM 1000 while in use, as well as more importantly provide safety from any sharp edges of the blades or cutlery elements being cleaned when folded within the side panels 410 and 420.

The plates can be formed of any material that is waterproof, having some substantial rigidity in nature, while either having some flexibility to the material as well (such as a soft metal, e.g., aluminum) or a plastic material which is capable of longitudinal bending after assembly, particularly the centrally located plate 330. The plates 310, 320 and 330 may be comprised of the same materials or each one of a different material such that the overall function of the spine 450 and side panels 410 and 420 sufficiently protect and provide the necessary form for the ASCM 1000. The plates 310, 320, and 330 may be sized and dimensioned to each have the same dimension or different dimensions. For example, the centrally located panel 330 may be smaller than the side plates 310 and 320. An exemplary measurement for the plates may include the range of height of 0.75 to 2.25 inches, a width of 2-4 inches, and a thickness between 0.02 to 0.1 inches. In one embodiment, a preferred dimension for a plate (310, 320 or 330) may be 3.25 inches wide, 1.5 inches tall, and 0.032 inches thick. The plates should be sized and dimensioned such that they align and cover a majority of the surface area of the fabric layer 400 so as to provide sufficient coverage and protection for the user. In one embodiment, this coverage of the plates (It is also to be understood by one of ordinary skill in the art that although a set of three plates 310, 320 and 330 are shown and described, one or more (e.g., more than three plates) may be employed to align the fabric layer 400.

FIG. 6A more clearly indicates the manner in which the plates 310, 320 and 330 may be bonded or attached to an interior side 405 of the fabric layer 400. Each of the plates 310, 320 and 330 may have a bonding area 315, 325, 335 providing a physical portion of the where the plates are attached to the fabric layer 400. The bonding areas 310, 320 and 330 are shown centrally located relative to each of the plates 310, 320 and 330, however, it is to be understood that they may be central, or offset in any necessary manner so as to effectively attach the plates 310, 320 and 330 to the fabric layer 400. The plates 310, 320 and 330 may be attached by any suitable methods including chemical, thermal or mechanical attachment methods. These include any variety of bonding solutions, or thermal bonding processes, or mechanical attachment means, or any combinations thereof. In one embodiment, the attachment means 317, 327 and 337 may comprise a set of fabric stitchery to connect the plates 310, 320 and 330 to the interior 405 side. FIG. 6B shows the back side or exterior side 407 of the fabric layer 400.

In another embodiment of an ASCM 3000, as illustrated in FIG. 9, the armored cleaning mitt may comprise multiple layers consisting of an interior, abrasive scouring layer 105 coupled to the fabric layer 400. The scouring layer 105 may be bonded, attached, fastened, stitched or otherwise connected to the fabric layer 400 and may further comprise a set of armoring plates 310, 310, and 330 there between. The interior abrasive scouring layer 105 may be formed of one or more layers of scouring materials which may form a contiguous abrasive surface area for contact with the sharp edged object and for removing any hard to remove debris on the cutting edge's surface, e.g., food on a knife's cutting surface.

It is to be appreciated that one or more of the elements depicted in the drawings/figures can also be implemented in a more separated or integrated manner, or even removed or rendered as inoperable in certain cases, as is useful in accordance with a particular application. It is also within the spirit and scope of the present invention to implement a program or code that can be stored in a machine-readable medium to permit a computer to perform any of the methods and procedures described herein.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used and/or to the particular embodiment disclosed as the best mode contemplated for carrying out this invention, but that the invention will include any and all embodiments and equivalents falling within the scope of the instant disclosure.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

What is claimed is:

1. An armored sponge cleaning mitt for cleaning sharp edges and cutlery devices, said armored sponge cleaning mitt comprising a plurality of layers, wherein a first interior layer is comprised of scouring material forming a contiguous abrasive surface area, wherein a second intermediate layer is an absorbent, porous material, and wherein a third exterior fabric layer is a cloth fabric material; and wherein said first interior layer is bound to said second intermediate layer, and said third exterior layer is also bound to said second intermediate layer such that said intermediate layer is betwixt said first and third layer; and said armored sponge containing a set of rigid armoring members comprised of at least three unitary substantially rigid plates, wherein said set of rigid armoring members are encased and carried by said third exterior fabric layer, and each plate contains at least one aperture for providing fluid drainage between said layers.

2. The armored sponge of claim 1, wherein said third exterior layer contains a longitudinal central spine portion for defining folding sections to thereby divide the armored sponge cleaning mitt and define at least two panel sides of said armored sponge cleaning mitt; and wherein each of said panel sides contains a plate encased within said fabric layer, and said central spine portion contains a central plate located therein; and wherein said central plate overlaps each of said plates on said panel sides.

3. The armored sponge cleaning mitt of claim 2 wherein each said aperture of said set of rigid armoring members also defining a bonding portion for operatively coupling said armoring members to said fabric layer; and wherein said bonding portion is bonded to an interior layer of said fabric layer.

4. The armored sponge cleaning mitt of claim 3 further comprising a set of gripping members for providing friction engagement for the hand of a wearer when using said armored sponge; and said set of gripping members connected to said exterior surface of said fabric layer.

5. The armored sponge cleaning mitt of claim 4 wherein said set of gripping members is comprised of a set of straps attached to either sides of said exterior surface of said fabric layer.

6. The armored sponge cleaning mitt of claim 5 wherein at least one of said rigid plates is comprised of metal.

7. The armored sponge cleaning mitt of claim 6 wherein at least one of said rigid plates is comprised of plastic.

8. The armored sponge cleaning mitt of claim 7 wherein said rigid plates are each connected to said interior side of said fabric layer at said bonding portion.

9. The armored sponge cleaning mitt of claim 8, wherein the absorbent porous layer is comprised of a sponge material.

* * * * *